US007914646B2

(12) United States Patent
Duggirala et al.

(10) Patent No.: US 7,914,646 B2
(45) Date of Patent: Mar. 29, 2011

(54) COMPOSITIONS AND PROCESSES FOR PAPER PRODUCTION

(75) Inventors: Prasad Y. Duggirala, Naperville, IL (US); Sergey M. Shevchenko, Aurora, IL (US); Katherine M. Broadus, Aurora, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 11/490,738

(22) Filed: Jul. 21, 2006

(65) Prior Publication Data

US 2008/0017337 A1 Jan. 24, 2008

(51) Int. Cl.
*D21F 11/00* (2006.01)
*D21C 9/10* (2006.01)

(52) U.S. Cl. ..... 162/158; 162/70; 162/162; 8/119; 8/648

(58) Field of Classification Search ..... 162/70, 162/158, 162; 8/648, 119
See application file for complete search history.

(56) References Cited

U.S. PATENT DOCUMENTS

| | | | | |
|---|---|---|---|---|
| 3,018,287 | A * | 1/1962 | Fleck | 544/83 |
| 3,619,355 | A * | 11/1971 | Silberman | 162/135 |
| 4,435,248 | A * | 3/1984 | Arakawa | 162/12 |
| 4,576,609 | A * | 3/1986 | Hageman et al. | 8/103 |
| 5,464,501 | A * | 11/1995 | Kogan et al. | 162/6 |
| 5,637,193 | A * | 6/1997 | Hassi et al. | 162/78 |
| 6,302,997 | B1 * | 10/2001 | Hurter et al. | 162/65 |
| 2002/0104627 | A1 * | 8/2002 | Denton et al. | 162/78 |
| 2003/0094252 | A1 * | 5/2003 | Sundar et al. | 162/128 |
| 2004/0050511 | A1 | 3/2004 | Lambert | |
| 2007/0193707 | A1 * | 8/2007 | Nguyen | 162/70 |
| 2007/0277947 | A1 * | 12/2007 | Nguyen | 162/71 |

FOREIGN PATENT DOCUMENTS

| | | | |
|---|---|---|---|
| EP | 0899373 | A1 * | 3/1999 |
| FI | 104339 | B | 12/1999 |
| WO | WO 99/32710 | | 7/1999 |
| WO | WO 00/32729 | | 6/2000 |
| WO | WO 00/52258 | | 8/2000 |
| WO | WO 2005001198 | A1 * | 1/2005 |
| WO | WO 2005121442 | A1 * | 12/2005 |

OTHER PUBLICATIONS

Rocik Thomas, Optical Brighteners in Fine Papers, 1999, TAPPI Press,whole document.*

Smook, Handbook for Pulp and Paper Technologists, 1992, Angus Wilde Publications, 2nd edition, p. 228, 283.*

Certified English Translation WO 2005001198 Ochi et al.*

Certified English Translation WO 2005 121442 Miyawaki et al.*

Calgon Carbon Corporation website, About UV Oxidation and Disinfection [downloaded online from: www.uvdisinfections.com], 2003 [downloaded online Dec. 3, 2008], whole document.*

Millipore Corporation, What is Ultraviolet Photo-Oxidation [downloaded online from www.millipore.com], 2008 downloaded online Dec. 3, 2008, whole document.*

Gullichsen et al., Chemical Pulping 6A, 1999, Fapet Oy,p. A653.*

Jukka Jakara et al, "The Use of Peracetic Acid As a Brightening Agent" Preprint-PAPTAC Annual Meeting, 87th, Montreal, QC, Canada Jan. 30-Feb. 1, 2001.

Jukka Jakara et al., "The Effect of Peracetic Acid in Fine Paper Production." (Abstract) Appita Annual Conference Proceedings (2000), 54th (vol. 1), 169-174.

Jukka Jakara et al., The Use of Peracetic Acid As a Brightening Agent. (Abstract) Appita Ann. General Conf. Proc. (1999), 53rd (vol. 2), 463-467.

* cited by examiner

*Primary Examiner* — Matthew J Daniels
*Assistant Examiner* — Anthony J Calandra
(74) *Attorney, Agent, or Firm* — Michael B. Martin

(57) ABSTRACT

Oxidative compositions and processes that preserve and enhance the brightness and improve color of pulp or paper when applied during different stages of the papermaking process are identified. The oxidative composition and method maintains and/or enhances brightness, prevents yellowing, and enhances the performance of paper products. Used in combination with optical brighteners and/or chelants the oxidative agents produce a synergistic effect not previously identified in the paper process.

15 Claims, No Drawings

COMPOSITIONS AND PROCESSES FOR PAPER PRODUCTION

TECHNICAL FIELD

This invention relates to compositions and processes for improving brightness and optical properties, preventing loss of brightness and for enhancing resistance to thermal yellowing in pulp and paper manufacture. More particularly, this invention concerns compositions comprising oxidizing agents, which either alone or in the presence of optical brightening agents effectively enhance the brightness and optical properties of a paper product as well as increase its thermal stability.

BACKGROUND OF THE INVENTION

Pulps produced by either mechanical or chemical pulping methods possess a color that can range from dark brown to creamish depending on the wood type and defibering process used. The pulp is bleached to produce white paper products for a multiplicity of applications.

Bleaching is the removal or alteration of those light-absorbing substances found in unbleached pulp. In the bleaching of mechanical pulp, the object is to decolorize the pulp without solubilizing the lignin. Either reducing (e.g. sodium hydrosulfite) or oxidizing (e.g., hydrogen peroxide) bleaching agents are usually used. The bleaching is often a multistage process. The bleaching of chemical pulps is an extension of the delignification that started in the digestion stage. The bleaching is often a multistage process, which stages may include chlorine dioxide bleaching, oxygen-alkaline delignification, and peroxide bleaching.

Discoloration, mostly ascribed to thermal aging, results in yellowing and brightness loss in various stages of papermaking processes employing bleached pulp and in the resultant paper products. The industry invests significantly in chemicals such as bleaching agents and optical brighteners that improve optical properties of the finished paper or paper products.

For example, post bleaching processes in which pulp is brought to the desired whiteness using peracids acid are disclosed in WO 0052258 and WO 9932710. Addition of a composition comprising peracetic acid and hydrogen peroxide to thick stock prior to the addition of optical brightening agents (OBA's) is claimed to reduce the amount of OBA's required to achieve a comparable degree of brightness in GB2391011. Jukka Jakara et al., The effect of peracetic acid treatment of bleached kraft pulp in fine paper production, Preprint-PAPTAC Annual Meeting, 87$^{th}$, Montreal, QC, Canada Jan. 30-Feb. 1, 2001 (2001) discloses that addition of peracetic acid to the stock preparation chests of paper machines limits brightness reversion in bleached pulp and results in significant savings in OBA addition in the paper machine. See also, Jukka Jakara et al., The effect of peracetic acid in fine paper production, Appita Annual Conference Proceedings (2000), 54$^{th}$ (Vol. 1), 169-174 and Jukka Jakara et al., The use of peracetic acid as a brightening agent, Appita Ann. General Conf. Proc. (1999), 53$^{rd}$ (Vol. 2), 463-467. Treatment of bleached stock with peroxyacid prior to addition of neutral size to the stock is disclosed in FI104339B. Peroxide preparations containing optical brighteners in encapsulated form are disclosed in CA2292107.

To date, however, the results have been less than satisfactory and the economic losses resulting from discoloration and yellowing present significant ongoing challenges to the industry. Accordingly, there remains a need for a successful and practical solution to loss of brightness and undesirable yellowing of pulp and paper.

SUMMARY OF THE INVENTION

The present invention provides compositions and methods for improving and stabilizing brightness and enhancing resistance to yellowing in the papermaking process.

In an aspect, this invention is a method of preparing a bleached pulp material having enhanced brightness and enhanced resistance to thermal yellowing comprising: i) providing bleached pulp material; and ii) contacting the bleached pulp material with an effective amount of one or more oxidizing agents excluding organic peroxyacids.

In another aspect, this invention is a method of making a paper product having enhanced brightness and resistance to thermal yellowing comprising i) providing bleached pulp; ii) forming an aqueous stock suspension comprising the bleached pulp; iii) draining the stock suspension to form a sheet; and drying the sheet, wherein a) an effective amount of one or more oxidizing agents excluding organic peroxyacids is added to the bleached pulp or the stock suspension, or b) an effective amount of one or more oxidizing agents including organic peroxyacids is added on to the sheet.

In another aspect, this invention is a method of making a paper product having enhanced brightness and resistance to thermal yellowing comprising i) providing bleached pulp; ii) forming an aqueous thick stock suspension comprising the bleached pulp; iii) adding an effective amount of one or more oxidants and one or more optical brighteners to the thick stock; iv) diluting the aqueous thick stock suspension to form a thin stock suspension; v) draining the thin stock suspension to form a sheet; and vi) drying the sheet.

In another aspect, this invention is a method of preventing brightness loss and yellowing of a bleached pulp material during storage comprising adding an effective amount of one or more oxidizing agents excluding organic peroxyacids to the bleached pulp material.

In another aspect, this invention is a bleached pulp material which comprises the mixed product of bleached pulp and an effective amount of one or more oxidizing agents, wherein said bleached pulp material has a higher brightness and enhanced resistance to thermal yellowing, when compared with similar pulp not treated with said reducing agents.

Applicant has also discovered that oxidizing agents in combination with chelants effectively enhances the brightness of paper products and further that oxidizing agents used in combination with optical brighteners enhance the effect of the optical brighteners and improve color scheme. Accordingly, in additional aspects, this invention is methods of using oxidizing agents in combination with chelants and/or optical brighteners to prepare bleached pulp materials having higher brightness, enhanced resistance to thermal yellowing and improved color schemes.

The oxidizing agent, optical brighteners and chelants may be used alone or in combination with known additives to enhance the quality of the desired paper product.

DETAILED DESCRIPTION OF THE INVENTION

The present invention provides an improved process for making paper and paper products exhibiting high optical brightness. Brightness stabilization against thermal yellowing, color improvement and brightness enhancement of bleached pulp and paper product prepared from the bleached pulp can be achieved by adding one or more oxidizing agents as defined herein to pulp, paper, paperboard or tissue anywhere in the papermaking process.

Brightness is a term used to describe the whiteness of pulp or paper, on a scale from 0% (absolute black) to 100% (relative to a MgO standard, which has an absolute brightness of about 96%) by the reflectance of blue light (457 nm) from the paper. "Thermal brightness loss" is a brightness loss in paper and pulp under the influence of time, temperature and moisture (non-photochemical brightness loss). "Brightness loss during storage" is thermal brightness loss over time under storage conditions.

Yellowing of a bleached pulp material (brightness reversion) is the loss of brightness of bleached pulp, paper, paperboard, paper tissue and related materials prepared from the bleached pulp over a period of time. As used herein, "bleached pulp material" includes bleached pulps as well as paper products prepared from such pulps.

The oxidizing agents described herein are suitable for use on any bleached pulp material used in papermaking processes and any paper product prepared from the bleached pulp. As used herein, "bleached pulp material" means bleached pulp and paper products prepared from the bleached pulp including paper, paperboard, tissue, and the like.

Oxidizing agents according to this invention include chemical substances capable of transforming functional groups in the bleached pulp material from a lower oxidation category to a higher oxidation category. The benefits of this transformation include increased brightness stability in the paper machine and enhanced performance of optical brighteners.

Representative oxidizing agents include, but are not limited to, hydrogen peroxide, organic peroxyacids, organic and inorganic peroxides (hydroperoxides), superoxides and peroxide -superoxides, inorganic peroxy acids and salts thereof, peroxyhydrates, water-soluble organic peroxides including dioxiranes, nitrogen oxide, nitrosodisulfonates, hypochlorites, hypobromites, chlorites, chlorates and perchlorates, bromates, chlorine dioxide, chloroamines, chloroamides, chlorosulfonamides, bromoamines, bromoamides, bromosulfamides, chlorosulfonic acid, chlorine and all of the above in combinations.

As used herein, "hydrogen peroxide" means $H_2O_2$.

"Organic peroxyacid" means compounds of formula $R_1C(O)O_2H$ and metal salts thereof where $R_1$ is selected from alkyl, alkenyl, aryl and arylalkyl. Representative organic peroxyacids include peroxybenzoic acid, $C_6H_5C(O)OOH$, peracetic acid (PAA), $CH_3C(O)OOH$, performic acid, $HC(O)OOH$, perpropionic acid, $CH_3CH_2C(O)OOH$, and the like.

"Inorganic peroxides" means monobasic (hydroperoxides) and dibasic (peroxides) metal derivatives of hydrogen peroxide, $H_2O_2$, including alkali and alkaline earth metal derivatives such as sodium hydroperoxide (NaOOH), magnesium peroxide ($MgO_2$), and the like.

"Superoxides" means metal derivatives containing the group of $O_2^-$, including alkali and alkaline earth metal derivatives such as sodium superoxide ($NaO_2$), calcium superoxide ($CaO_2$), and the like.

"Peroxide-superoxides" means mixed alkali metal derivatives of a formula $2MO_2.M_2O_2$, where M is an alkali metal, such as $K_2O_3$, and the like.

"Inorganic peroxy acids and salts thereof" means inorganic acids containing a O—O— group, including peroxy monoacids containing the group —OOH and peroxy diacids containing the group —O—O—, and their metal salts, such as peroxymonosulfuric acid (Caro's acid, $(HO)_2SO_2OOH$), peroxydisulfinuric acid ($HOSO_2OOSO_2OH$), peroxymonophosphoric acid $H_3PO_5$, sodium peroxymonocarbonate $Na_2CO_4$ and peroxydicarbonate $Na_2C_2O_6$, and the like.

"Peroxyhydrates are inorganic salts containing hydrogen peroxide of crystallization, such as sodium metasilicate peroxyhydrate $Na_2SiO_3.H_2O_2.H_2O$, and sodium borate peroxyhydrate $NaBO_2.H_2O_2.3H_2O$, and the like.

"Organic peroxides" are any organic chemicals containing a —O—O— group, including organic peroxyacids as defined herein, dioxiranes such as dimethyldioxyrane $(CH_3)_2CO_2$, and the like.

"Nitrosodisulfonates" are alkali and alkaline earth metal salts of nitrosodisulfonic acid such as potassium nitrosodisulfonate (Fremy's salt) $(KSO_3)_2NO$, and the like.

"Hypochlorites", "chlorites", "chlorates" and "perchlorates", are water-soluble metal salts of hypochlorous HOCl, chlorous HOClO, chloric $HOClO_2$ and perchloric $HOClO_3$ acids, respectively, such as sodium hypochlorite, NaOCl, and the like.

"Hypobromites" and "bromites" are water soluble salts of hypobromous acid, HOBr, and bromic acid, $HBrO_3$, respectively, including sodium hypobromite, NaOBr, and the like.

"Chloroamines" and "bromoamines" are ammonium derivatives of the formulae $NH_xHal_y$, where Hal is Cl or Br, or alkylamine derivatives $NR_1R_2Hal_x$, where $R_1$ and $R_2$ are defined above and x and y are independently 1-3. In aqueous solution, chloramines and bromoamines may be present as the corresponding ammonium salts.

"Chloroamides" and "bromoamides" are amide derivatives containing $—C(O)N(R_1)_pH_qHal_r$ groups where Hal is defined above, p and q are independently 0-1 and r is 1-2, such as product compositions formed in a mixture of sodium hypochlorite NaClO and urea $H_2NCONH_2$ or sodium hypochlorite NaClO and 5,5-dimethylhydantoin, and the like.

"Chlorosulfamides" and "bromosulfamides" are amide derivatives containing $—SO_2N(R_1)_pH_qHal_r$, where $R_1$, Hal, p, q and r are defined above, such as the product composition formed in a mixture of sodium hypochlorite, NaClO, and sulfamide, $H_2NSO_2NH_2$, and the like.

Chlorosulfonic acid is a chemical of the formula $ClSO_3H$.

"Alkyl" means a monovalent group derived from a straight- or branched-chain saturated hydrocarbon by the removal of a single hydrogen atom. The alkyl may be unsubstituted or substituted with one or more groups selected from amino, alkoxy, hydroxy and halogen. Representative alkyl groups include methyl, ethyl, n- and iso-propyl, n-, sec-, iso- and tert-butyl, and the like.

"Alkylene" means a divalent group derived from a straight or branched chain saturated hydrocarbon by the removal of two hydrogen atoms, for example methylene, 1,2-ethylene, 1,1-ethylene, 1,3-propylene, 2,2-dimethylpropylene, and the like.

"Amino" means a group of formula $—NY_1Y_2$ where $Y_1$ and $Y_2$ are independently selected from H, alkyl, alkenyl, aryl and arylalkyl. Representative amino groups include amino ($—NH_2$), methylamino, ethylamino, isopropylamino, diethylamino, dimethylamino, methylethylamino, and the like. In aqueous solution, amines may be present as the corresponding ammonium salts.

"Aryl" means aromatic carbocyclic radicals and heterocyclic radicals having about 5 to about 14 ring atoms. The aryl may be unsubstituted or substituted with one or more groups selected from amino, alkoxy, hydroxy and halogen. Representative aryl include phenyl, naphthyl, phenanthryl, anthracyl, pyridyl, furyl, pyrrolyl, quinolyl, thienyl, thiazolyl, pyrimidyl, indolyl, and the like.

"Arylalkyl" means an aryl group attached to the parent molecular moiety through an alkylene group. Representative arylalkyl groups include benzyl, 2-phenylethyl, and the like.

"Halo" and "halogen" mean chlorine, fluorine, bromine and iodine.

"Salt" means the metal, ammonium, substituted ammonium or phosphonium salt of an inorganic or organic anionic counterion. Representative metals include sodium, lithium, potassium, calcium, magnesium, and the like. Representative anionic counterions include sulfite, bisulfite, sulfoxylate, metabisulfite, thiosulfate, polythionate, hydrosulfite, formamidinesulfinate, and the like.

The oxidizing agent may be used in combination with one or more "activators". The activators include compositions which enhance the effect of the oxidizing agent through catalysis of the oxidiation reaction or change in the pH, or both. Representative activators include, but are not limited to, phosphoric acid, monosodium phosphate, monosodium sulfate, monosodium carbonate, TEMPO (2,2,6,6-tetramethylpiperydidnyoloxyl), 4-hydroxy-TEMPO (4-hydroxy-2,2,6,6-tetramethylpiperydidnyoloxyl), ammonium molybdate, tetraacetylethylenediamine (TAED) and pH-changing chemicals affecting oxidation rates such as acetic acid. "Activated oxidizing agent" means an oxidizing agent used in combination with one or more activators. In some embodiments, the oxidizing agent is activated hydrogen peroxide.

In some embodiments, the bleached pulp material may be treated with one or more oxidizing agents and one or more reducing agents. "Reducing agents" refers to chemical substances capable of transforming functional groups in the bleached pulp material from a higher oxidation category to a lower oxidation category. The use of reducing agents for improving and stabilizing brightness and enhancing resistance to yellowing in the papermaking process is described in copending Ser. No. 11/397,499, filed Mar. 23, 2006.

Representative reducing agents include sulfites, bisulfites, metabisulfites (pyrosulfites), sulfoxylates, thiosulfates, dithionites (hydrosulfites), polythionates, formamidinesulfinic acid and salts and derivatives thereof, formaldehyde bisulfite adduct and other aldehyde bisulfite adducts, sulfinamides and ethers of sulfinic acid, sulfenamides and ethers of sulfenic acid, sulfamides, phosphines, phosphonium salts, phosphites, and thiophosphites.

"Sulfites" means dibasic metal salts of sulfurous acid, $H_2SO_3$, including dibasic alkali and alkaline earth metal salts such as sodium sulfite ($Na_2SO_3$), calcium sulfite ($CaSO_3$), and the like.

"Bisulfites" means monobasic metal salts of sulfurous acid, $H_2SO_3$, including alkali and alkaline earth metal monobasic salts such as sodium bisulfite ($NaHSO_3$), magnesium bisulfite ($Mg(HSO_3)_2$), and the like.

"Sulfoxylates" means salts of sulfoxylic acid, $H_2SO_2$, including zinc sulfoxylate ($ZnSO_2$), and the like.

"Metabisulfites (Pyrosulfites)" means salts of pyrosulfurous acid, $H_2S_2O_5$, including sodium metabisulfite ($Na_2S_2O_5$), and the like.

"Thiosulfates" means salts of thiosulfurous acid, $H_2S_2O_3$, including potassium thiosulfate ($Na_2S_2O_3$), and the like.

"Polythionates" means salts of polythionic acid, $H_2SnO_6$ (n=2-6), including sodium trithionate ($Na_2S_3O_6$), salts of dithionic acid, $H_2S_2O_6$, such as sodium dithionate $Na_2S_2O_6$, and the like.

"Dithionites (hydrosulfites)" means salts of dithionous (hydrosulfurous, hyposulfurous) acid, $H_2S_2O_4$, including sodium dithionite (hydrosulfite) ($Na_2S_2O_4$), magnesium dithionite ($MgS_2O_4$), and the like.

"Formamidinesulfinic acid (FAS)" means a compound of formula $H_2NC(=NH)SO_2H$ and its salts and derivatives including the sodium salt $H_2NC(=NH)SO_2Na$.

"Aldehyde bisulfite adducts" means compounds of formula $R_1CH(OH)SO_3H$ and metal salts thereof where $R_1$ is selected from alkyl, alkenyl, aryl and arylalkyl. Representative aldehyde bisulfite adducts include formaldehyde bisulfite adduct $HOCH_2SO_3Na$, and the like.

"Sulfinamides and ethers of sulfinic acid" means compounds of formula $R_1—S(=O)—R_2$, where $R_1$ is defined herein and $R_2$ is selected from $OR_3$ and $NR_4R_5$, where $R_3$-$R_5$ are independently selected from selected from alkyl, alkenyl, aryl and arylalkyl. Representative sulfinamides include ethylsulfindimethylamide ($CH_3CH_2S(=O)N(CH_3)_2$), and the like.

"Sulfenamides and ethers of sulfenic acid" means compounds of formula $R_1—S—R_2$, where $R_1$ and $R_2$ are defined above. Representative sulfenamides include ethylsulfendimethylamide ($CH_3CH_2SN(CH_3)_2$), and the like.

"Sulfamides" means compounds of formula $R_1—C(=S)—NR_4R_5$, where $R_1$, $R_4$ and $R_5$ are defined above. Representative sulfamides include $CH_3CH_2C(=S)N(CH_3)_2$, and the like.

"Phosphines" means derivatives of phosphine, $PH_3$, normally organic substituted phosphines of the formula $R_6R_7R_8P$ where $R_6$-$R_8$ are independently selected from H, alkyl, alkenyl, aryl, arylalkyl and $NR_4R_5$ where $R_4$ and $R_5$ are defined above. Representative phosphines include $(HOCH_2)_3P$ (THP), and the like.

"Phosphites" means derivatives of phosphorous acid $P(OH)_3$, including organic substituted phosphites of the formula $(R_3O)(R_4O)(R_5O)P$ where $R_3$-$R_5$ are defined above. Representative phosphites include $(CH_3CH_2O)_3P$, and the like.

"Thiophosphites" means derivatives of phosphorothious acid $HSP(OH)_2$, including organic substituted thiophosphites of formula $(R_3O)(R_4O)(R_5S)P$ where $R_3$-$R_5$ are defined above. Representative thiophosphites include $(CH_3CH_2O)_2(CH_3CH_2S)P$, and the like.

"Phosphonium salts" means organic substituted phosphines of the formula $R_1R_3R_4R_5P^+X^-$, where $R_1$ and $R_4$-$R_5$ are as defined above and X is any organic or inorganic anion. Representative phosphonium salts include $(HO_2CCH_2CH_2)_3P^+HCl^-$ (THP), $[(HOCH_2)_4P^+]_2(SO_4)^{2-}$ (BTHP), and the like.

"Alkenyl" means a monovalent group derived from a straight or branched hydrocarbon containing at least one carbon-carbon double bond by the removal of a single hydrogen atom. The alkenyl may be unsubstituted or substituted with one or more groups selected from amino, alkoxy, hydroxy and halogen.

"Alkoxy" means an alkyl group attached to the parent molecular moiety through an oxygen atom. Representative alkoxy groups include methoxy, ethoxy, propoxy, butoxy, and the like. Methoxy and ethoxy are preferred.

In an embodiment, the reducing agent is selected from the group consisting of substituted phosphines, sulfites, bisulfites and metabisulfites. A preferred reducing agent is sodium bisulfite.

The process of the present invention can be practiced on conventional papermaking equipment. Although papermaking equipment varies in operation and mechanical design, the processes by which paper is made on different equipment contain common stages. Papermaking typically includes a pulping stage, bleaching stage, stock preparation stage, a wet end stage and a dry end stage.

In the pulping stage, individual cellulose fibers are liberated from a source of cellulose either by mechanical or chemical action, or both. Representative sources of cellulose include, but are not limited to, wood and similar "woody" plants, soy, rice, cotton, straw, flax, abaca, hemp, bagasse, lignin-containing plants, and the like, as well as original and recycled paper, paper tissue and paperboard. Such pulps include, but are not limited to, groundwood (GWD), bleached groundwood, thermomechanical pulps (TMP), bleached thermomechanical pulps, chemi-thermomechanical pulps (CTMP), bleached chemi-thermomechanical pulps, deinked pulps, kraft pulps, bleached kraft pulps, sulfite pulps, and bleached sulfite pulps. Recycled pulps may or may not be bleached in the recycling stage, but they are presumed to be originally bleached. Any of the pulps described above which have not previously been subjected to bleaching may be bleached as described herein to provide a bleached pulp material.

In an embodiment, the bleached pulp material is selected from the group consisting of virgin pulp, recycled pulp, kraft, sulfite pulp, mechanical pulp, any combination of such pulps, recycled paper, paper tissue, and any paper made from such listed pulps or combinations thereof.

A further advantage of this invention is that it allows for substituting lower-priced mechanical pulp for higher priced kraft in printing grade kraft-mechanical paper. Use of the chemistry and methods described herein increases the brightness and stability toward yellowing, therefore permitting the use of higher amounts of mechanical pulp, with corresponding reduction in cost, without loss of quality in the resulting paper product.

The pulp is suspended in water in the stock preparation stage. Additives such as brightening agents, dyes, pigments, fillers, antimicrobial agents, defoamers, pH control agents and drainage aids also may be added to the stock at this stage. As the term is used in this disclosure, "stock preparation" includes such operations as dilution, screening and cleaning of the stock suspension that may occur prior to forming of the web.

The wet end stage of the papermaking process comprises depositing the stock suspension or pulp slurry on the wire or felt of the papermaking machine to form a continuous web of fibers, draining of the web and consolidation of the web ("pressing") to form a sheet. Any papermaking machine known in the art is suitable for use with the process of the present invention. Such machines may include cylinder machines, fourdrinier machines, twin wire forming machines, tissue machines, and the like, and modifications thereof.

In the dry end stage of the papermaking process, the web is dried and may be subjected to additional processing like size pressing, calendering, spray coating with surface modifiers, printing, cutting, corrugating and the like. In addition to a size press and calender waterbox, the dried paper can be coated by spray coating using a sprayboom.

In embodiments where the oxidizing agents are added prior to sheet formation, oxidizing agents other than organic peroxyacids are used. When the oxidizing agents are applied after sheet formation or where oxidizing agents are added to thick stock in combination with optical brighteners, oxidizing agents including organic peroxyacids are used.

Accordingly, in embodiments where the oxidizing agents are added prior to sheet formation, the oxidizing agents may be selected from hydrogen peroxide, inorganic peroxides, superoxides and peroxide-superoxides, inorganic peroxyacids and salts thereof, peroxyhydrates, water-soluble organic peroxides, nitrosodisulfonates, hypochlorites, hypobromites, chlorites, chlorates, bromates, perchlorates, chlorine dioxide, chloroamines, chloroamides, chlorosulfamides, bromoamines, bromoamides, bromosulfamides, chlorosulfonic acid, bromosulfonic acid and chlorine.

In other embodiments where the oxidizing agents are added prior to sheet formation, the oxidizing agents may be selected from hydrogen peroxide, activated hydrogen peroxide, hypochlorites, hypobromites, chloroamines, chloroamides, chlorosulfamides, bromoamines, bromoamides, bromosulfamides, chlorosulfonic acid and bromosulfonic acid.

In embodiments where the oxidizing agents are added after sheet formation or where the oxidizing agents are added to thick stock in combination with optical brighteners, the oxidizing agents may be selected from hydrogen peroxide, organic peroxyacids, inorganic peroxides, superoxides and peroxide-superoxides, inorganic peroxyacids and salts thereof, peroxyhydrates, water-soluble organic peroxides, nitrosodisulfonates, hypochlorites, hypobromites, chlorites, chlorates, bromates, perchlorates, chlorine dioxide, chloroamines, chloroamides, chlorosulfamides, bromoamines, bromoamides, bromosulfamides, chlorosulfonic acid, bromosulfonic acid and chlorine.

In other embodiments where the oxidizing agents are added after sheet formation or where the oxidizing agents are added to thick stock in combination with optical brighteners the oxidizing agents may be selected from is selected from hydrogen peroxide, activated hydrogen peroxide, peracetic acid, hypochlorites, hypobromites, chloroamines, chloroamides, chlorosulfamides, bromoamines, bromoamides, bromosulfamides, chlorosulfonic acid and bromosulfonic acid.

The oxidants may be pre-formulated or may be formed in-situ from mixed components as is known in the art. In-situ preparation may be desirable under certain circumstances, for example when the desired oxidizing agent is relatively unstable or is quickly consumed in the system. For example peracetic acid and peracetic acid-hydrogen peroxide mixtures may be formed in situ by mixing hydrogen peroxide and tetraacetylethylenediamine. Hypobromite can be prepared in-situ by mixing sodium bromide and sodium hypochlorite. Chloramines may be prepared in-situ by mixing ammonium bromide, urea or dimethylhydantoin and sodium hypochlorite. Chlorosulfamates may be prepared in-situ by mixing sodium bromide, sodium hypochlorite and sulfamic acid.

Applicant has also discovered that oxidizing agents in combination with chelants as described below effectively enhance the brightness of a paper product via increased thermal stability of the pulp and reduction of chromophoric structures in pulp.

In an embodiment, one or more chelants are added to the bleached pulp or paper product. Suitable chelants according to this embodiment include compounds that are capable of chelating transitional metals that form colored products with pulp constituents and catalyze color-forming reactions in the bleached pulp or paper products.

Representative chelants include, but are not limited to, organic phosphonates, phosphates, carboxylic acids, dithiocarbamates, salts of any of the previous members, and any combination thereof.

"Organic phosphonates" means organic derivatives of phosphonic acid, $HP(O)(OH)_2$, containing a single C—P bond, such as HEDP ($CH_3C(OH)(P(O)(OH)_2)$, 1-hydroxy-1, 3-propanediylbis-phosphonic acid ($(HO)_2P(O)CH(OH)CH_2CH_2P(O)(OH)_2)$); preferably containing a single C—N bond adjacent (vicinal) to the C—P bond, such as DTMPA ($(HO)_2P(O)CH_2N[CH_2CH_2N(CH_2P(O)(OH)_2)_2]_2$), AMP ($N(CH_2P(O)(OH)_2)_3$), PAPEMP ($((HO)_2P(O)CH_2)_2NCH(CH_3)CH_2(OCH_2CH(CH_3))_2N(CH_2)_6N(CH_2P(O)(OH)_2)_2$), HMDTMP ($(HO)_2P(O)CH_2)_2N(CH_2)_6N(CH_2P(O)(OH)_2)_2$), HEBMP ($N(CH_2P(O)(OH)_2)_2CH_2CH_2OH$), and the like.

"Organic phosphates" means organic derivatives of phosphorous acid, $P(O)(OH)_3$, containing a single C—P bond, including triethanolamine tri(phosphate ester) ($N(CH_2CH_2OP(O)(OH)_2)_3$), and the like.

"Carboxylic acids" means organic compounds containing one or more carboxylic group(s), —C(O)OH, preferably aminocarboxylic acids containing a single C—N bond adjacent (vicinal) to the C—$CO_2H$ bond, such as EDTA ($(HO_2CCH_2)_2NCH_2CH_2N(CH_2CO_2H)_2$), DTPA ($(HO_2CCH_2)_2NCH_2CH_2N(CH_2CO_2H)CH_2CH_2N(CH_2CO_2H)_2$), and the like and alkaline and alkaline earth metal salts thereof.

"Dithiocarbamates" include monomeric dithiocarbamates, polymeric dithiocarbamates, polydiallylamine dithiocarbamates, 2,4,6-trimercapto-1,3,5-triazine, disodium ethylenebisdithiocarbamate, disodium dimethyldithiocarbamate, and the like.

In an embodiment, the chelant is selected from the group consisting of diethylene-triamine -pentamethylene phosphonic acid (DTMPA) and salts thereof, diethylenetriaminepentaacetic acid (DTPA) and salts thereof and ethylenediaminetetraacetic acid (EDTA) and salts thereof.

Applicant has also discovered that oxidizing agents used in combination with optical brighteners ("OBA's") enhance the effect of optical brighteners (OBA). The oxidizing agents also improve the color scheme. This permits reduction of the amount of OBA's and brighteners such as blue dyes necessary to achieve comparable brightness and color. Replacing some of the OBA and dyes with oxidizing agents allows pulp and paper manufacturers to reduce production costs and reduce the overall amount of OBA and dyes present, while maintaining an acceptable level of brightness in the paper product and achieving the target color. In some cases it may be possible to eliminate dyes entirely and maintain color.

Accordingly, in another embodiment, one or more optical brighteners ("OBA's") are added to the bleached pulp or paper product.

"Optical brighteners" are fluorescent dyes or pigments that absorb ultraviolet radiation and reemit it at a higher frequency in the visible spectrum (blue), thereby effecting a white, bright appearance to the paper sheet when added to the stock furnish. Representative optical brighteners include, but are not limited to azoles, biphenyls, coumarins; furans; ionic brighteners, including anionic, cationic, and anionic (neutral) compounds, such as the Eccobrite® and Eccowhite® compounds available from Eastern Color & Chemical Co. (Providence, R.I.); naphthalimides; pyrazenes; substituted (e.g., sulfonated) stilbenes, such as the Leucophor® range of optical brighteners available from the Clariant Corporation (Muttenz, Switzerland), and Tinopal® from Ciba Specialty Chemicals (Basel, Switzerland); salts of such compounds including but not limited to alkali metal salts, alkaline earth metal salts, transition metal salts, organic salts and ammonium salts of such brightening agents; and combinations of one or more of the foregoing agents.

In an embodiment, the optical brighteners are selected from the group of disulfonated, tetrasulfonated and hexasulfonated Tinopal® OBAs.

The dosage of oxidizing agents, reducing agents, chelants and/or optical brighteners is the amount necessary to achieve the desired brightness and resistance to yellowing of the bleached pulp or paper product prepared from the bleached pulp and can be readily determined by one of skill in the art based on the characteristics of the reducing agent, chelant or optical brightener, the pulp or paper being treated and the method of application. Reducing agents may be added to the bleached pulp material before or after the oxidizing agents. Chelants and optical brighteners may be added before, after or simultaneously with the oxidizing agents or may be formulated with the oxidizing agents for addition to the bleached pulp material.

The effective amount of oxidizing agent added to the bleached pulp or paper product is the amount of oxidizing agent which enhances the brightness and resistance to thermal yellowing of the pulp or paper compared to pulp or paper which is not treated with the oxidizing agents. Methods for determining brightness and resistance to thermal yellowing are described herein.

Typically, about 0.0005 to about 2, preferably about 0.05 to about 0.25 weight percent, based on oven-dried pulp of oxidizing agent is added to the bleached pulp or paper product.

As noted above, the oxidizing agent may be used in combination with one or more reducing agents. The reducing agent may be added before or after the oxidizing agent. The effective amount of reducing agent added to the bleached pulp or paper product is the amount of reducing agent which, in combination with the oxidizing agents, enhances the brightness and resistance to thermal yellowing of the pulp or paper compared to pulp or paper which is not treated with the reducing agents.

Typically, about 0.005 to about 2, preferably about 0.05 to about 0.25 weight percent, based on oven-dried pulp of reducing agent is added to the bleached pulp or paper product.

In a typical application, about 0.001 to about 1, preferably about 0.01 to about 0.1 weight percent of phosphonate, phosphate or carboxylic acid chelant and/or about 0.002 to about 0.02 weight percent of dithiocarbamates chelant based on oven-dried pulp is added to the bleached pulp or paper product.

Optical brighteners are typically added in amounts of about 0.005 to about 2, preferably 0.05 to about 1 weight percent of optical brightener based on oven-dried pulp.

The oxidizing agents, reducing agents, chelants and/or optical brighteners can be added to bleached pulp or paper at any point in the papermaking or tissue making process. Representative addition points include, but are not limited to (a) to the pulp slurry in the latency chest; (b) to the pulp after the bleaching stage in a storage, blending or transfer chest; (c) to pulp after bleaching, washing and dewatering followed by cylinder or flash drying; (d) before or after the cleaners; (e) before or after the fan pump to the paper machine headbox; (f) to the paper machine white water; (g) to the silo or save all; (h) in the press section using, for example, a size press, coater or spray bar; (i) in the drying section using, for example, a size press, coater or spray bar; (j) on the calender using a wafer box; and/or (k) on paper in an off-machine coater or size press; and/or (l) in the curl control unit.

The precise location where the oxidizing agents, reducing agents, chelants and/or optical brighteners should be added will depend on the specific equipment involved, the exact process conditions being used and the like. In some cases, the reducing agents, chelants and/or optical brighteners may be added at one or more locations for optimal effectiveness.

Application can be by any means conventionally used in papermaking processes, including by "split-feeding" whereby a portion of the reducing agent, chelant and/or optical brightener is applied at one point in the papermaking process, for example on pulp or a wet sheet (before the dryers) and the remaining portion is added at a subsequent point, for example in the size press.

In an embodiment, the oxidizing agents are applied to the bleached pulp material in a thin stock. For purposes of this embodiment, "thin stock" means a stock solution having a consistency of less than about 5% based on dry solids.

In an embodiment, the oxidizing agents are applied to the bleached pulp material in a thick stock, where "thick stock" means a stock solution having a consistency of about 5 to about 30% based on dry solids.

In an embodiment, the oxidizing agents are applied to a wet sheet.

In an embodiment, the oxidizing agents are applied in the size press.

The activators, chelants and/or optical brighteners can be added to the bleached pulp or paper product before, after or simultaneously with the oxidizing agent and with one another. Any reducing agents should be added before or after the oxidizing agent.

In a representative application using reducing agents and optical brighteners, the reducing agents may be added to the bleached pulp material before or after the optical brighteners, for example in the blend chest or in the thin stock.

In an alternate application, oxidizing agents optical brighteners and chelants may be added to the bleached pulp material in the storage, blending or transfer chest, in a thin stock or at the wet end and in the size press, where the relative dose of optical brighteners added in the wet end is reduced and the relative dose of optical brighteners in the size press is increased based on the observed higher response of the optical brighteners in the size press when used in combination with oxidizing agents as described herein. A preferred oxidant for use in the size press is peracetic acid.

Applicant has also discovered that addition of oxidizing agents and optical brighteners to thick stock enhances brightness of the bleached pulp material, improves wet end brightness stability and increases fluorescence of the optical brightener ("OBA" activation") when compared to oxidant addition to thick stock followed by OBA addition to thin stock. The oxidizing agents may be added to the thick stock before, after or simultaneously with the optical brighteners. The oxidizing agents may also be formulated with the optical brighteners for addition to the thick stock. A preferred oxidizing agent according to this embodiment is peracetic acid.

The oxidants may also be formulated with any chelants, optical brighteners, and/or activators in a single product for application to the bleached pulp material. A representative formulation comprises the oxidizing agent, one or more activators and optionally one or more chelants.

An alternative formulation comprises one or more oxidizing agents and one or more optical brighteners. This formulation may be applied to a wet paper sheet as-is or mixed in a surface sizing solution for application to the wet paper sheet. The formulation may also be applied in the size press.

The oxidizing agents, reducing agents, chelants and/or optical brighteners may also be used in combination with one or more partially neutralized polycarboxylic acids, preferably polycarboxylic acids such as polyacrylic acid ($CH_3CH(CO_2H)[CH_2CH(CO_2H)]_nCH_2CH_2CO_2H$, where n is about 10 to about 50,000. The polycarboxylic acid may be neutralized to the target pH, (typically 5-6 as discussed below) with alkali such as sodium hydroxide.

The oxidizing agents, reducing agents, chelants and optical brighteners and polycarboxylates may be used in addition to other additives conventionally used in papermaking to improve one or more properties of the finished paper product, assist in the process of manufacturing the paper itself, or both. These additives are generally characterized as either functional additives or control additives.

Functional additives are typically those additives that are use to improve or impart certain specifically desired properties to the final paper product and include but are not limited to brightening agents, dyes, fillers, sizing agents, starches, and adhesives.

Control additives are additives incorporated during the process of manufacturing the paper so as to improve the overall process without significantly affecting the physical properties of the paper. Control additives include biocides, retention aids, defoamers, pH control agents, pitch control agents, and drainage aids. Paper and paper products made using the process of the present invention may contain one or more functional additives and/or control additives.

Pigments and dyes impart color to paper. Dyes include organic compounds having conjugated double bond systems; azo compounds; metallic azo compounds; anthraquinones; triaryl compounds, such as triarylmethane; quinoline and related compounds; acidic dyes (anionic organic dyes containing sulfonate groups, used with organic rations such as alum); basic dyes (cationic organic dyes containing amine functional groups); and direct dyes (acid-type dyes having high molecular weights and a specific, direct affinity for cellulose); as well as combinations of the above-listed suitable dye compounds. Pigments are finely divided mineral that can be either white or colored. The pigments that are most commonly used in the papermaking industry are clay, calcium carbonate and titanium dioxide.

Fillers, are added to paper to increase opacity and brightness. Fillers include but are not limited to calcium carbonate (calcite); precipitated calcium carbonate (PCC); calcium sulfate (including the various hydrated forms); calcium aluminate; zinc oxides; magnesium silicates, such as talc; titanium dioxide ($TiO_2$), such as anatase or rutile; clay, or kaolin, consisting of hydrated $SiO_2$ and $Al_2O_3$; synthetic clay; mica; vermiculite; inorganic aggregates; perlite; sand; gravel; sandstone; glass beads; aerogels; xerogels; seagel; fly ash; alumina; microspheres; hollow glass spheres; porous ceramic spheres; cork; seeds; lightweight polymers; xonotlite (a crystalline calcium silicate gel); pumice; exfoliated rock; waste concrete products; partially hydrated or unhydrated hydraulic cement particles; and diatomaceous earth, as well as combinations of such compounds.

Sizing agents are added to the paper during the manufacturing process to aid in the development of a resistance to penetration of liquids through the paper. Sizing agents can be internal sizing agents or external (surface) sizing agents, and can be used for hard-sizing, slack-sizing, or both methods of sizing. More specifically, sizing agents include rosin; rosin precipitated with alum ($Al_2(SO_4)_3$); abietic acid and abietic acid homologues such as neoabietic acid and levopimaric acid; stearic acid and stearic acid derivatives; ammonium zirconium carbonate; silicone and silicone-containing compounds, such as RE-29 available from GE-OSI and SM-8715, available from Dow Corning Corporation (Midland, Mich.); fluorochemicals of the general structure $CF_3(CF_2)_nR$, wherein R is anionic, cationic or another functional group, such as Gortex; alkylketene dimer (AKD), such as Aquapel 364, Aquapel (I 752, Heron) 70, Hercon 79, Precise 787, Precise 2000, and Precise 3000, all of which are commercially available from Hercules, Incorporated (Willmington, Del.); and alkyl succinic anhydride (ASA); emulsions of ASA or AKD with cationic starch; ASA incorporating alum; starch; hydroxymethyl starch; carboxymethylcellulose (CMC); polyvinyl alcohol; methyl cellulose; alginates; waxes; wax emulsions; and combinations of such sizing agents.

Starch has many uses in papermaking. For example, it functions as a retention agent, dry -strength agent and surface sizing agent. Starches include but are not limited to amylose;

amylopectin; starches containing various amounts of amylose and amylopectin, such as 25% amylose and 75% amylopectin (corn starch) and 20% amylose and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; anionic starches; ampholytic starches (containing both cationic and anionic functionalities); cellulose and cellulose derived compounds; and combinations of these compounds.

The method of this invention yields paper products with a bright surface. Moreover, the novel composition further protects paper from long-term discoloration during regular use.

The foregoing may be better understood by reference to the following examples, which are presented for purposes of illustration and are not intended to limit the scope of the invention.

EXAMPLES

In these Examples, sufficient 50% aqueous sodium hydroxide was added to achieve appropriate pH for the agent or composition being tested. All percentages in these examples are given on a weight percent dry pulp basis.

In these Examples, the following terms shall have the indicated meaning.

Br for ISO brightness R457 (TAPPI 525); Ye for E313 yellowness; WI for E313 Whiteness; TMP for thermomechanical pulp; CTMP for chemi-thermomechanical pulp; RMP for refiner mechanical pulp; OBA for optical brightener; EDTA for $(HO_2CCH_2)_2NCH_2CH_2N(CH_2CO_2H)_2$, ethylenediaminetetraacetic acid; DTPA for $(HO_2CCH_2)_2NCH_2CH_2N(CH_2CO_2H)CH_2CH_2N(CH_2CO_2H)_2$, diethylenetriaminepentaacetic acid; DTMPA for $H_2O_3PCH_2N[CH_2CH_2N(CH_2PO_3H_2)_2]_2$, diethylene-triamine-pentamethylene phosphonic acid; PAA for peracetic acid.

Treatment

Handsheets were made of bleached pulp and then used in the experiments, in which the reducing agents were applied either on a wet sheet (before or after the press) before drum drying or after drum drying (temperature during drum drying: 100° C.). The third option was split-feed application. The surface sizing application was followed by one more round on a drum dryer.

The load of the tested Agent or Composition solution was determined based on the dry weight of the pulp sample. The Agent or Composition solutions were applied using a rod, as uniformly as possible, as solutions in water. The test sheets were dried using a laboratory drum drier under uniform conditions (one round).

The handsheets were made using (a) a Buchner funnel (5 g o.d. pulp, Ø15 cm, pressed and air-dried) and (b) Noble&Wood handsheet mold (8 in.sq., 60 g/m2). Brightness was measured using Elrepho and Technidyne instruments.

Test Equipment

Laboratory drum drier.

"Elrepho 3000," "Technidyne Color Touch 2 (Model ISO)" or another instrument for brightness measurements.

Hitachi F-4500 fluorescence spectrometer or another instrument for relative fluorescence intensity measurements.

Micropipette.

Surface size application kit (pad and size 3-application rod).

Constant humidity room (23° C., 50% humidity).

Water bath/thermostat accommodating a floating plastic box with paper samples 100-mL application cuvette for the soaking method.

Dry Surface Application Procedure (Surface Sizing, Soaking Method)

1. Prepare 8×8-inch hand sheet according to the standard procedure. The target dry weight is 2.5 g. Pass wet hand sheets through one cycle on the drum dryer.
2. Cut ⅛th strip of the sheet (0.31 g).
3. In a 50 ml test tube, prepare solutions of pre-cooked starch (if needed) and reducing agent compound solutions based on the pre-determined pickup rate and target dose.
4. Dip the paper strip into the solution for 10 seconds, let it drip for 35 seconds and then pass it through the press.
5. Drum-dry the test sheet and equilibrate at room temperature.
6. Measure brightness and yellowness.

Pulp Application Procedure:

The chemicals were added directly to the pulp (thin stock or thick stock) and mixed with the pulp in sealed bags. In a pulp application procedure for OBA enhancement the chemicals were added directly to the bleached kraft pulp at 20% consistency, mixed with the pulp in sealed bags and kept at 45-80° C. for 30 min. The pulp was diluted to 5% consistency, the OBA was added, mixed with the pulp, and the slurry was kept at 50° C. for 20 min. Then the slurry was further diluted and hand sheets prepared according to the standard procedure. OBA is added as a commercial product.

1. Combined Application of an Oxidant and OBA in Surface Sizing Solution.

TABLE 1

Softwood kraft, drum-dried handsheets, surface sizing application in starch (4.4% in paper)

| Treatment | Br | Br gain vs. Control | OBA activation |
|---|---|---|---|
| Control | 85.5 | | |
| 0.25% Tinopal ABP-A (OBA) | 90.2 | 4.7 | |
| 0.0375% PAA | 86.2 | 0.7 | |
| 0.075% PAA | 86.1 | 0.6 | |
| 0.0375% PAA + 0.25% OBA | 91.0 | 5.5 | 0.8 |
| 0.075% PAA + 0.25% OBA | 91.4 | 5.9 | 1.2 |
| 0.12% $H_2O_2$ | 85.8 | 0.3 | |
| 0.12% $H_2O_2$ + 0.25% OBA | 90.8 | 5.3 | 0.6 |
| 0.041% NaClO | 85.6 | 0.1 | |
| 0.041% NaClO + 0.25% OBA | 90.7 | 5.2 | 0.5 |
| 0.5% OBA | 94.2 | 8.7 | |
| 0.25% $NaH_2PO_4$ + 0.5% OBA | 94.8 | 9.3 | 0.6 |
| 0.12% $H_2O_2$ + 0.25% $NaH_2PO_4$ + 0.5% OBA | 95.5 | 10.0 | 1.3 |
| 0.12% $H_2O_2$ + 0.25% $NaHCO_3$ + 0.5% OBA | 95.1 | 9.6 | 1.0 |

We have discovered that optical brighteners can be combined with oxidant performance enhancers in a surface sizing solution. Generally, optical brighteners can react with oxidants. However, we found that the conditions of the surface sizing process are mild enough to prevent this from happening. Different oxidants positively affect performance of optical brighteners.

2. Application of Various Oxidants in Thick Stock Pulp (OBA is Applied upon Dilution of the Stock)

TABLE 2

Softwood kraft, drum-dried handsheets. Stage I—10% consistency; 60 C., 1 hr. Stage II—4% consistency, 60 C., 20 min.

| Treatment | Br | Br gain vs. Control | OBA activation |
|---|---|---|---|
| Control | 84.9 | | |
| 0.374% Tinopal ABP-A (OBA) | 96.9 | 12.0 | |
| 0.50% Ammonium persulfate | 84.8 | 0.0 | |
| 0.50% Ammonium persulfate + 0.374% OBA | 97.2 | 12.3 | 0.2 |
| 0.50% Sodium percarbonate | 86.1 | 1.3 | |
| 0.50% Sodium percarbonate + 0.374% OBA | 98.5 | 13.6 | 1.5 |
| 0.50% Sodium perborate | 85.6 | 0.8 | |
| 0.50% Sodium perborate + 0.374% OBA | 98.1 | 13.2 | 1.2 |
| 0.50% Chlororsulfamate | 84.5 | −0.4 | |
| 0.50% Chlorosulfamate + 0.374% OBA | 97.3 | 12.4 | 0.3 |
| Control—no incubation | 84.4 | | |

In this example, different oxidants are applied in thick stock followed by application of an OBA in a more diluted stock during the papermaking process. Several oxidants show a synergistic effect with an optical brightener.

3. Synergistic Effect of an Oxidative Pre-treatment on Optical Brighteners

TABLE 3

Hardwood kraft, air-dried handsheets. Stage I, oxidant application—10% consistency; 60° C., 3 hr. Stage II, OBA application—4% consistency, 60 C., 20 min (with or without OBA, Tinopal ABP-A).

| Oxidant | Dosage, % Actives[1] | Br Gain vs. OBA |
|---|---|---|
| NaOCl/NaBr/sulfamic acid 1:1.5:2 | 0.075 | 4.2 |
| Monochloramine | 0.075 | 2.3 |
| Sodium hypochlorite/dimethylhydantoin 1:1 | 0.075 | 2.9 |
| Sodium hypochlorite/urea 1:1 | 1.1-1.6 | 6.7 |

[1]% Actives are determined by measuring the total residual chlorine in a dilute sample according to EPA Method 330.5

TABLE 4

Hardwood kraft, air-dried handsheets. Stage I, oxidant application—10% consistency; 60° C., 3 hr. Stage II, OBA application—4% consistency, 60 C., 20 min (with or without OBA, Tinopal ABP-A).

| Oxidant | Dosage, % Actives[1] | Br gain vs. Control (no OBA) | Br Gain vs. OBA |
|---|---|---|---|
| NaOCl/NaBr/sulfamic acid 1:1.5:2 | 0.015 | 0.8 | 3.0 |
| NaOCl/urea 1:1 | 0.015 | 1.1 | 2.0 |

[1]% Actives are determined by measuring the total residual chlorine in a dilute sample according to EPA Method 330.5

The data shown in Tables 3 and 4 show the significant effect of different oxidants as OBA activators. Especially interesting is the documented significant improvement in OBA performance in absence of actual bleaching with PAA.

4. Application of Activated Hydrogen Peroxide

TABLE 5

Hardwood kraft, air-dried handsheets. Stage I, oxidant application—10% consistency; 60° C., 3 hr. Stage II, OBA application—4% consistency, 60 C., 20 min (with or without OBA, Tinopal ABP-A).

| Oxidant | Br Gain Vs. OBA |
|---|---|
| 0.12% $H_2O_2$ | 0.2 |
| 0.12% $H_2O_2$ + 0.79% Tetraacetylethylenediamine | 1.7 |
| 0.12% $H_2O_2$ + 0.5% Monosodium phosphate | 1.8 |
| 0.12% $H_2O_2$ + 0.05% Ammonium molybdate | 1.0 |

TABLE 6

Hardwood kraft, air-dried handsheets. Stage I, oxidant application—10% consistency; 60° C., 3 hr. Stage II, OBA application—4% consistency, 60 C., 20 min (with or without OBA, Tinopal ABP-A).

| Oxidant | Br Gain Vs. OBA |
|---|---|
| 0.0375% $H_2O_2$ | 0.5 |
| 0.0375% $H_2O_2$ + 0.5% Monosodium phosphate | 3.1 |
| 0.0375% $H_2O_2$ + 0.25% Monosodium phosphate | 2.6 |

TABLE 7

Hardwood kraft, air-dried handsheets. Stage I, oxidant application—10% consistency; 60° C., 3 hr. Stage II, OBA application—4% consistency, 60 C., 20 min (with or without OBA, Tinopal ABP-A).

| Oxidant | Br Gain Vs. OBA |
|---|---|
| 0.12% $H_2O_2$ | 0.6 |
| 0.12% $H_2O_2$ + 0.50% $H_3PO_4$ | 4.0 |
| 0.12% $H_2O_2$ + 0.25% $NaHCO_3$ | 1.7 |
| 0.12% $H_2O_2$ + 0.50% $NaHCO_3$ | 4.3 |
| 0.12% $H_2O_2$ + 0.05% Nalco 03PO0054[1] | 3.3 |

[1]Peroxide stabilizer based on DTMPA, available from Nalco Company, Naperville, IL.

The data shown in Tables 5-7 illustrate different ways of activating hydrogen peroxide that results in its significantly improved performance in the process.

5. Application of Oxidant Compositions in the Thick and Thin Stock; Application of Oxidant Compositions in the Thick Stock Together with an OBA

TABLE 8

Hardwood, alkaline pulp, drum-dried handsheets. Stage I, oxidant application -10% consistency; 60° C., 3 hr. Stage II, OBA application—4% consistency, 60 C., 20 min (with or without OBA, Tinopal ABP-A).

| Oxidant | Br gain vs. OBA, 4% Consistency | Br. Gain vs. OBA, 10% Consistency |
|---|---|---|
| NaOCl/NaBr/sulfamic acid 1:1.5:2 (0.0125% actives) | 0.2 | 1.1 |
| 0.09% $H_2O_2$ + 0.3% Monosodium phosphate | 0.5 | 1.0 |

Table 8 illustrates application of the oxidative chemistry on pulp of lower (4%) and higher (10%) consistency (hardwood, 0.35% OBA as product).

TABLE 9

| Hardwood, drum-dried handsheets. | | |
|---|---|---|
| Oxidant | Br gain vs. OBA, 0.45% OBA added together with the Oxidant at 10% consistency | Br gain vs. OBA, the Oxidant added at 10% consistency; 0.45% OBA added later at 4% consistency (30 min, 60 C.) |
| Pulp #1, alkaline | | |
| 0.019% PAA | 0.8 | 0.4 |
| Pulp #2, kraft | | |
| 0.019% PAA | 1.8 | |
| 0.038% PAA | 2.4 | |
| 0.075% PAA | 2.5 | |

Table 9 illustrates performance of the oxidative chemistry when OBA and the oxidant are applied together in the thick stock (10% consistency). For comparison, an example of the lesser gain achieved when the chemistries are applied consecutively is given.

While the present invention is described above in connection with representative or illustrative embodiments, these embodiments are not intended to be exhaustive or limiting of the invention. Rather, the invention is intended to cover all alternatives, modifications and equivalents included within its spirit and scope, as defined by the appended claims.

The invention claimed is:

1. A method of making a paper product having enhanced brightness improved color scheme and enhanced resistance to thermal yellowing comprising:

i) providing bleached pulp;

ii) forming an aqueous stock suspension comprising the bleached pulp;

iii) draining the stock suspension to form a sheet;

iv) drying the sheet, and v) treating the sheet with an oxidant composition comprising one or more oxidizing agents at about 0.0005 to about 2 weight percent on oven-dried pulp, one or more optical brighteners, and optionally one or more chelants, optionally one or more reducing agents, or combinations thereof, and wherein said oxidizing agents are selected from the group consisting of hydrogen peroxide, organic peroxyacids, inorganic peroxides, superoxides and peroxide-superoxides, organic and inorganic peroxyacids and salts thereof, peroxyhydrates, water-soluble organic peroxides, nitrosodisulfonates, hypochlorites, hypobromites, chlorites, chlorates, bromates, perehlorates, chlorine dioxide, chloroamines, chloroamides, chlorosulfamides, bromoamines, bromoarnides, bromosulfamides, chlorosulfonic acid, bromosulfonic acid and chlorine and wherein said bleached pulp material has a minimum ISO brightness of 84.4 and the oxidant composition excludes starch when the oxidant comprises hydrogen peroxide, organic peroxyacids, inorganic peroxides, superoxides and peroxide-superoxides, organic and inorganic peroxyacids and salts thereof, peroxyhydrates, and water-soluble organic peroxides.

2. The method of claim 1, wherein the chelant is added and is selected from the group consisting of organic phosphates, phosphates, carboxylic acids, salts of any of the previous members, and any combination thereof.

3. The method of claim 1 wherein the optical brighteners are selected from dilsulfonated, tetrasulfonated or hexasulfonated stilbene derivatives.

4. The method of claim 1, wherein the chelant is added and is selected from the group consisting of diethylene-triamine-pentamethylene phosphonic acid (DTMPA) and salts thereof, diethylenetriaminepentaacetic acid (DTPA) and salts thereof and ethylenediaminetetraacetic acid (EDTA) and salts thereof.

5. The method of claim 1, wherein the reducing agent is added and is selected from the group consisting of substituted phosphines, sulfites, bisulfites and metabisulfites.

6. The method of claim 1 wherein the one or more oxidizing agents and one or more optical brighteners are added onto a wet sheet.

7. The method of claim 6 wherein the oxidizing agent is peracetic acid.

8. The method of claim 1 wherein the one or more oxidizing agents and one or more optical brighteners are added to the bleached pulp material in the size press.

9. The method of claim 8 wherein the oxidizing agent is peracetic acid.

10. The method of claim 8 wherein the one or more oxidizing agents and one or more optical brighteners are mixed in a single product or in a surface sizing solution that is applied to the bleached pulp material in the size press.

11. The method of claim 1 wherein the oxidizing agent is peracetic acid.

12. The method of claim 1 wherein the aqueous stock suspension is an aqueous thick stock suspension.

13. The method of claim 12 wherein one or more oxidants and one or more optical brighteners are additionally added to the thick stock suspension.

14. The method of claim 1, wherein the oxidizing agent is applied in combination with one or more activators selected from the group consisting of phosphoric acid, monosodium phosphate, monosodium sulfate, monosodium carbonate, 2,2,6,6-tetramethylpiperydidnyoloxyl, 4-hydroxy-2,2,6,6-tetramethylpiperydidnyoloxyl, ammonium molybdate, DTMPA, tetraacetylethylenediamine and acetic acid.

15. The method of claim 14 wherein the oxidizing agent is hydrogen peroxide activated with phosphoric acid, monosodium phosphate, monosodium carbonate, ammonium molybdate, DTMPA or tetraacetylethylenediamine.

* * * * *